US005917530A

United States Patent [19]

Hutt et al.

[11] Patent Number: 5,917,530

[45] Date of Patent: Jun. 29, 1999

[54] DYE DIFFUSION THERMAL TRANSFER PRINTING

[75] Inventors: Kenneth Hutt, Wix; Ian Richard Stephenson, Ipswich; Ha Cong Tran, Manningtree; Richard Anthony Hann, Ipswich; Dafydd Geraint Davies, Cambridge; Alan John Harry, Melbourn Nr. Royston; Paul David Pester, Huntington, all of United Kingdom

[73] Assignee: Imperial Chemical Industries plc, London, United Kingdom

[21] Appl. No.: 08/581,610

[22] PCT Filed: Jul. 18, 1994

[86] PCT No.: PCT/GB94/01547

§ 371 Date: Jun. 3, 1996

§ 102(e) Date: Jun. 3, 1996

[87] PCT Pub. No.: WO95/02510

PCT Pub. Date: Jan. 26, 1995

[30] Foreign Application Priority Data

Jul. 16, 1993 [GB] United Kingdom ..... 9314800

[51] Int. Cl.[6] ..... B41J 31/14; B41J 31/16

[52] U.S. Cl. ..... 347/171; 347/213

[58] Field of Search ..... 347/171, 213; 400/197

[56] References Cited

U.S. PATENT DOCUMENTS 4,462,035 7/1984 Koto .

FOREIGN PATENT DOCUMENTS

| | | | |
|---|---|---|---|
| 0029313 | 5/1981 | European Pat. Off. . | |
| 0282080 | 9/1988 | European Pat. Off. . | |
| 0 608 881 | 8/1994 | European Pat. Off. . | |
| 0 609 149 | 8/1994 | European Pat. Off. . | |
| 628426 A1 | 12/1994 | European Pat. Off. . | |
| 55-55881 | 4/1980 | Japan . | |
| 55-91692 | 7/1980 | Japan . | |
| 58-104772 | 6/1983 | Japan | 347/171 |
| 58-138686 | 8/1983 | Japan . | |
| 58-151288 | 9/1983 | Japan . | |
| 63-62784 | 3/1988 | Japan . | |
| 2-002079 | 1/1990 | Japan . | |
| 4-355180 | 12/1992 | Japan . | |
| 2178698 | 4/1990 | United Kingdom . | |

*Primary Examiner*—Huan Tran

*Attorney, Agent, or Firm*—Alix, Yale & Ristas, LLP

[57] ABSTRACT

A dye donor, such as a transfer ribbon, comprises a supporting substrate and a relatively thick dye layer consisting of a dye dispersed within a dye binder. A heater, such as a modulated scanning laser beam, heats selected pixel regions of the ribbon and causes dye to diffuse from the heated regions to a receiver sheet and print a number of pixels thereon which build up to form an image. In order to allow the donor to be reused, it is passed between a pair of heated rollers to cause dye in the dye layer to diffuse to an even density whereby the regions depleted of dye during the print process are replenished. Instead of the replenishment dye coming from the body of the donor, it may be supplied by a separate source.

10 Claims, 5 Drawing Sheets

DYE DIFFUSION THERMAL TRANSFER PRINTING

BACKGROUND OF THE INVENTION

1. Field of the Invention

The present invention relates to dye diffusion thermal transfer printing, which should be taken to cover sublimation transfer printing, and relates particularly to the efficient use of dye in such printing, the term "dye" being taken to cover dyes, inks and other soluble colorants.

2. Description of the Prior Art

In diffusion thermal transfer printing, heat is applied to selected pixel areas of a dye donor sheet or ribbon by a suitable heat source, such as a series of resistive heating wires or a scanning laser beam. This heating causes diffusion of dye in the selected areas, and transfer of the dye to form printed pixels on an adjacent receiver sheet or ribbon.

The transfer may also be by sublimation, wherein the heating of the donor sheet causes the dye to enter the vapour phase. The dye then crosses an air gap and condenses onto the surface of the receiver sheet from where it may then diffuse inwards.

After printing, the dye sheet or ribbon is left with a number of dye depleted pixel areas where the dye has transferred to the receiver. The dye sheet or ribbon cannot therefore be reused, and must be discarded after a single print from the sheet or after the end of the ribbon is reached. This is wasteful, as much dye still remains on the dye sheet or ribbon in the regions which were not printed from.

SUMMARY OF THE INVENTION

The present invention aims to provide a system which is less wasteful of dye, and, from a first aspect, provides a dye diffusion thermal transfer printing system comprising dye donor means carrying an amount of thermally diffusible dye, receiver means for receiving dye from the donor means, and means for heating selected regions of the donor means to cause dye in those regions to transfer to the receiver means, wherein means are provided for replenishing, with thermally diffusable dye, regions of the donor means which have become depleted of dye through printing.

From a second aspect, the invention provides a method of dye diffusion thermal transfer printing in which selected regions of a dye donor means are heated to cause dye in those regions to transfer to a receiver means, wherein regions of the donor means which have become depleted in dye through printing are replenished with thermally diffusable dye.

The replenishment of the dye depleted regions allows the donor means to be used repeatedly, so that it need not be discarded after merely a single print run or at the ribbon end. Therefore, at least some of the dye remaining in the unprinted regions of the donor means is not lost, and may be used during further print operations. Moreover, savings are also provided because the dye donor means itself is re-used. For example, a dye ribbon may typically comprise a substrate for supporting a dye layer, a dye binder within which dye is dispersed to form a dye layer, and a laser light absorbing material either as a separate layer or dispersed with the dye, and, by the present invention, all of these materials are able to be re-used.

In a preferred form, the depleted regions are supplied with dye from other regions of the donor means. In this case, means may be provided for supplying heat to the donor means after printing to cause dye from undepleted regions of the donor means to diffuse into the depleted regions. This replenishment heating means may heat the donor means in any suitable manner. It need not be of as high an intensity as the print heating means and, indeed, it is preferable for the replenishment heating means to operate at a low power level to provide a more even dispersion of dye.

In this preferred self-reservoir form, the donor means may comprise a dye ribbon or sheet having a supporting substrate with a dye layer thereon which is thicker than is standard to enable sufficient dye to be held within the layer to replenish the dye transfer regions over a plurality of print cycles. The dye diffuses from the body of the layer to replenish the dye depleted surface regions. In this embodiment, the replenishment heat may be applied directly to the dye layer side of the ribbon or sheet, and/or through the substrate. Heating through the substrate may be preferable, as it promotes faster dye diffusion from regions of the dye layer close to the substrate to the dye depleted regions produced at the dye layer surface.

The replenishment heating means may take any suitable form, and may comprise a radiant element over which the ribbon or sheet passes. Alternatively, the heating means may contact the ribbon or sheet, with the ribbon or sheet passing over a flat or arcuate face of the heating means. In one preferred form, the heating means comprises roller means, having one or more rollers in contact with the ribbon or sheet, and one or more of the rollers heated. This has the advantage that the roller means may also be used to wind on the ribbon or sheet during printing. Also, two opposed rollers provide better ribbon/sheet contact.

If the replenishment heating means contacts the donor means surface, then it is preferred for the heating means to have a surface to which the donor means has no or very little adhesion, and which has low affinity for the dye. For example, the heating means may comprise a polypropylene coated surface, such as polypropylene coated paper against which the dye sheet or ribbon may be heated by a hot roll laminator.

When using a ribbon, it may be wound on separate spools or housed within a reversible cassette, and, may be heated to replenish the dye depleted regions during a rewind operation after the whole ribbon has been printed from. The ribbon may also form a continuous loop, the system having a print station at one position along the loop and a replenishment station at another.

When using a dye sheet, it may be replaceably mounted on a rigid support means and moved from a print station to a replenishment station, or may be mounted on the outer periphery of a rotating drum with print and replenishment stations at circumferentially spaced positions adjacent the drum. These arrangements allow the dye sheet to be handled easily, the dye sheet remaining on the support means for a number of print runs, until its dye concentration becomes too low and it is replaced.

In a further self-reservoir form of the dye donor means, the donor means may comprise a dye pad consisting of a solid body portion throughout which dye may diffuse, such as a dye filled porous pad. A dye pad can be more robust and have better handling properties than a ribbon, and, moreover, may hold more dye and so last longer before needing to be replaced. Indeed, it may be possible to refill the pad once the dye in it has been used up over a number of print runs.

The pad may be in any suitable form, and may comprise a solid block having a flat or arcuate printing surface which lies against the receiver means, in use, and which either moves between print and replenishment heating positions, or is stationary at the print position and is surrounded by heating means, and/or contains heating means within it, to ensure that dye continually diffuses to the pad printing surface during printing. This may be achieved, for example, by an elongate pad having one, preferably tapering, end mounted to face the receiver means, and with the heating means lying along and around a length of the pad.

The pad could also be in the form of a roller having printing and replenishment stations around its periphery, with perhaps also heating means mounted within the roller to ensure that dye nearer the centre of the roller may diffuse toward the outer regions where dye depletion takes place.

In a preferred form, a laser is used to heat selected regions of a dye pad which is in the form of a porous carbon roller which may be made by sintering or any other conventional process for forming a porous carbon element. Here, the carbon itself absorbs the laser energy, thus becoming hot and transferring the heat to the dye.

The carbon pore sizes need to be controlled to ensure uniform heating and dye retention, with very small pores leading to excessive resistance to dye rising to the surface and very large pores giving uneven printing. Pore sizes of between about 0.01 and 10 $\mu$m in diameter have been found to work well, with pore diameters of between about 0.05 and 2 $\mu$m being preferred.

After transfer, the roller can be heated by radiation heating (e.g. from a filament lamp), as discussed above, or by electrical heating, using the resistive properties of the carbon.

When using a dye pad such as a carbon roller, it can be desirable to incorporate a carrier material into the composition, which can aid in transfer of the dye to the receiver medium, but whose principle use is to provide faster equilibrium at the surface of the pad during the replenishment process. It has been mentioned that the pad may from time to time be refilled, and the replenishment mixture will depend on the extent of uptake of the various components in the pad by the receiver. This need not correspond to the optimum concentration for the whole pad. For example, if carrier molecules are present and transfer more slowly than the dye, then a lower concentration of the molecules will be desirable in the replenishment mixture.

An alternative to using a carbon roller as the dye pad is to use a thick coating of, for example, dye, binder and infra-red absorber on a solid mandrel. This coating may be up to 10 mm thick and consist of equal parts of the three components. Here, a radiation heating element or light bulb may be used to heat the surface to redistribute the dye. Again, a carrier material may be provided. In this embodiment, the dye concentration will eventually become too low to allow printing, and the pad will need replacing. This may be delayed by regularly removing the surface of the pad, thus removing the portion which has become most depleted in dye, and incidentally removing any contaminants that may have accumulated at or near the surface.

These contaminants may be particulate in nature (e.g. dust) or may arise from chemical decomposition of the dye, binder or IR absorber due to continual thermal cycling. They could also include dyes that have been clawed back out of the image as printed by previous pads in a colour printing sequence (discussed later).

Removal of the surface layer may conveniently be carried out by a hot blade or by applying a porous sheet, such as paper, to the hot surface to carry away the surface layer.

In a further embodiment, the dye pad may comprise filter paper, which may be in the form of a sheet and may be mounted on a supporting roller. Such a sheet may be, for example, a millimeter or more thick.

The replenishing dye need not necessarily be contained within the dye donor means, and may be held in a separate source which transfers dye to the donor means. This can be advantageous, since, as mentioned above, the dye concentration in a self-reservoir donor means may eventually fall so low that further printing from the donor means will not be possible. Also, the dye in the donor means may deteriorate over time. By providing fresh dye from a separate source, however, these problems may be overcome.

This separate dye source may take the form of a heated dye reservoir, such as a heated porous pad, dye being transferred to the donor means during contact with the reservoir. Alternatively, the source could also replenish the dye donor means by exposing it to dye vapour. Separate heating means may be provided after the replenishment point, in order to ensure that the newly transferred dye is evenly distributed in the donor means.

A donor means for use with this separate dye source may take the form of a dye transfer ribbon or sheet, similar to the ribbon and sheet self-reservoir arrangements mentioned above, but, in this case, the dye layer need not be so thick, and the ribbon or dye sheet may pass over a heated dye reservoir whilst contacting a surface of the reservoir from which dye diffusion to the ribbon or sheet takes place. This reservoir may be in the form of a block having a flat or arcuate surface, or in the form of a dye roller with perhaps an opposing pressure roller to urge the ribbon or sheet against the dye roller. As in the above self-reservoir arrangements, the ribbon may be continuous, rewindable and mounted in a cassette, while the dye sheet may be mounted on a support such as a rotating drum.

The donor means may alternatively be in the form of a pad movable from a print position to a replenishment position, in contact with a dye reservoir, or may be in the form of a roller having print means and reservoir means at circumferentially placed positions about its periphery. The portion of the pad which carries the dye need not be as thick as for the above-mentioned self-reservoir reservoir pads, since the dye will always be supplied to and transferred from the pad surface regions.

In all the above embodiments, be they self-reservoir or not, the print heating means for transferring dye from the donor to the receiver means may take any suitable form such as an array of resistive heating wires, an array of laser beams, a scanning laser beam, or even ultrasound. These print heating means may be arranged, as is standard, to heat the selected pixel regions through the dye donor means. For example, a laser beam may pass through the supporting substrate and heat the body of the dye layer before heating the dye at the desired surface transfer regions. In a preferred form, however, the print heating means heats the dye donor means through the receiver means. This may be achieved, for example, with a heat source of resistive heating wires, by employing a thin receiver means having good thermal conduction properties, or, with a laser source, by using a receiver means which is transparent to the laser light. By this arrangement, the dye in the regions of the dye layer nearest the receiver means may be heated first, without the heat needing to spread through the body of the dye layer. This then increases print speed, and is especially advantageous where the donor means is its own reservoir and the dye layer has a relatively high thickness. Moreover, the support substrate of the dye ribbon or sheet does not need to be transparent to a laser beam or thin enough to allow heat from resistive wires to penetrate efficiently, and so may be made from a wider range of materials and in a more rugged, for example thicker, form, so that it is better able to survive a number of print runs. Furthermore, this arrangement allows the print heat source to be on the opposite side of the receiver means to the donor means, which can simplify the construction of the apparatus when using a dye pad or other rigid dye carrier, as the bulk of the dye pad or carrier could otherwise hinder the mounting of the source and the application of heat to the donor means transfer regions near the receiver.

That is not to say, however, that arrangements with the pad and print heating means on the same side of the receiver means are not possible. For example, a rotating drum having a dye sheet thereon may be hollow and have a peripheral wall transparent to the light from a laser source mounted within, but separately from, the drum. Further, a stationary dye pad may have a channel extending therethrough, the end of the channel being bridged by a thin dye donor element which is continually supplied with dye diffusing from the rest of the pad. A laser beam may then be guided along the channel to impinge on and heat dye in the donor element and provide dye transfer, or resistive wires could be mounted in the channel. Such a pad could take the form of a cylinder with the thin dye donor element extending across one of the cylinder ends or could comprise two or more separate pad portions connected together at one end by a thin bridge element. In either case, the pad or pad portions and replenishment heating means need to be arranged to ensure continuous diffusion of dye from the pad or pad portions to the thin dye donor element.

The systems of the present invention may be used to print full colour images by forming a number of separate prints onto a single receiver sheet, each separate print using a dye of a different colour, for example yellow, cyan and magenta. A problem which may occur, however, is that dye already printed onto the receiver means may reverse migrate during a subsequent print to contaminate the next donor means. Measures may therefore be taken to prevent this from happening. In one method, the receiver means is heated after each individual dye print, so that the dye penetrates deeper into the receiver means. This leaves less dye at the receiver surface, and so there will be less reverse migration to a subsequent dye source. In addition or as an alternative to this, the receiver means may have a sublayer which is more attractive to the dye than is the surface layer, so that dye is pulled in to again leave less dye at the surface layer.

It is also possible to fix the dye in the receiver means between each dye print. This may be done in several ways. For example, the dye may be fixed chemically by a suitable reactive species in the receiver medium, especially by means of acid-base reactions or by complexation (mordanting) reactions of suitable dyes. Such reactions are known in the art for diffusion thermal transfer printing practised with thermal heads and disposable ribbons. The fixation of the dye can impede the uptake of further dyes by the receiver layer, and it is sometimes necessary to provide separate receiver layers for each colour. Thus, after printing a yellow dye, for example, a new receiving layer with appropriate fixing properties for a magenta dye may be applied to the surface of the print. An alternative is to incorporate fixing agents specific to each colour distributed throughout the receiver layer, so that the system does not become saturated with one colour and reject further dye.

A further method of reducing reverse migration is to reduce the dye mobility by illuminating the receiver means with ultraviolet light or other suitable radiation. A receiver of suitable composition becomes cross-linked, thus impeding the reverse migration of dye. Further receiver layers are then applied as above.

A number of physical methods may also be used to prevent reverse migration. For example, a thin film may be laminated onto the surface of the receiver means after each dye print, the film being impenetrable to dye on the side adjacent the receiver means, but receptive to dye on its opposite side so that a subsequent dye may be printed onto it.

Another measure is to print each separate dye onto separate receiver means, and to then laminate the receiver means together. It is preferable, in this case, for each receiver means to be quite thin, and they may therefore be mounted onto a substrate after printing for extra support.

A further approach is to provide an air gap between the dye donor and receiver means, in which case dye transfer may occur by sublimation. Reverse transfer of dye is then reduced by the air gap, which may also act as a barrier to the heating of the dyes already on the receiver means. The air gap may be provided by microspheres protruding from the dye donor or receiver means' surfaces.

The receiver means need not of course be the final article onto which a print is to be formed and may be an intermediate carrier which bulk transfers a printed image of one or more dye colours to one or more further receiver means. The intermediate carrier is preferably impermeable to the dye or dyes used so as to ensure that the print is easily transferrable to a further receiver means. The intermediate carrier may be kept warm, so that the dye is a liquid or soft solid to allow the bulk transfer of the printed image to a further receiver means by the application of pressure. In another embodiment, both heat and pressure are applied to produce the bulk transfer, whilst, in still another embodiment, the bulk transfer may be by sublimation of the dye across an air gap.

Use of an intermediate carrier has the advantage that the diffusion properties of a dye are not so important at the bulk transfer stage, and so it is possible to print onto a wider range of receiver materials. Also, when producing colour prints, the intermediate carrier may transfer each dye colour separately and be cleaned between each transfer, so that dye from a previous print does not contaminate a subsequent dye source. An air gap could also or alternatively be used, as described above.

A preferred form of intermediate carrier is a roller made of glass or other laser light transparent inorganic material. A laser beam may then pass through the roller to cause the dye transfer, and the roller may then carry the dye to the final receiver. Virtually all dye can transfer from a glass roller to the final receiver, because glass has very little affinity for dye, and so all of the dye remains on the roller surface and does not penetrate into the roller body. It is preferred to use an air gap, so that sublimation transfer takes place and a solid dye deposit forms on the roller surface. This gap may conveniently be defined by frosting the roller surface, for example by using a mechanical or chemical etching process to provide the desired relief. It is preferred for the depth of the features to be between about 0.5 and 30 $\mu$m, and advantageously, between about 2 and 10 $\mu$m. The final transfer may be advantageous achieved by passing the receiver medium through a nip between the glass roller and a heated rubber roller.

Where the print heat source is a laser or other radiation source, the dye donor means must be able to absorb the radiation energy to heat the dye. Therefore, either the dye needs to be able to absorb the radiation, or a separate radiation absorber dispersed with the dye or formed as a separate layer needs to be provided. Where the donor means is a dye pad, it could itself absorb the laser energy, e.g. the carbon roller discussed above. Where the donor means contains its own reservoir of dye and the radiation absorber is in a separate layer, this layer is preferably permeable to the dye so that it can be arranged near the transfer surface of the donor means without preventing dye diffusing through this layer to the surface regions from deeper within the donor means. If the radiation absorber is the dye or transfers to the receiver with the dye, and if the radiation reaches the dye source through the receiver means, it is preferable for each separate coloured dye, or the radiation absorber used with each separate dye, to absorb radiation of different wavelengths, as otherwise the dye or radiation absorber already transferred to the receiver means may impede further heating of the donor means, through its absorption of the radiation energy.

The dye will normally be dispersed within a suitable binder, such as polyvinyl butyral. In order to facilitate dye replenishment, it may be advantageous to use a binder which becomes somewhat fluid at the temperature of the replenishment heating, such as a chlorinated wax, for example Cereclor 70.

BRIEF DESCRIPTION OF THE DRAWINGS

Embodiments of the present invention will now be described, by way of example only, with reference to the accompanying drawings, in which like reference numerals refer to like elements in the several figures and wherein.

DESCRIPTION OF THE ENCLOSED EMBODIMENTS

Figure 1:
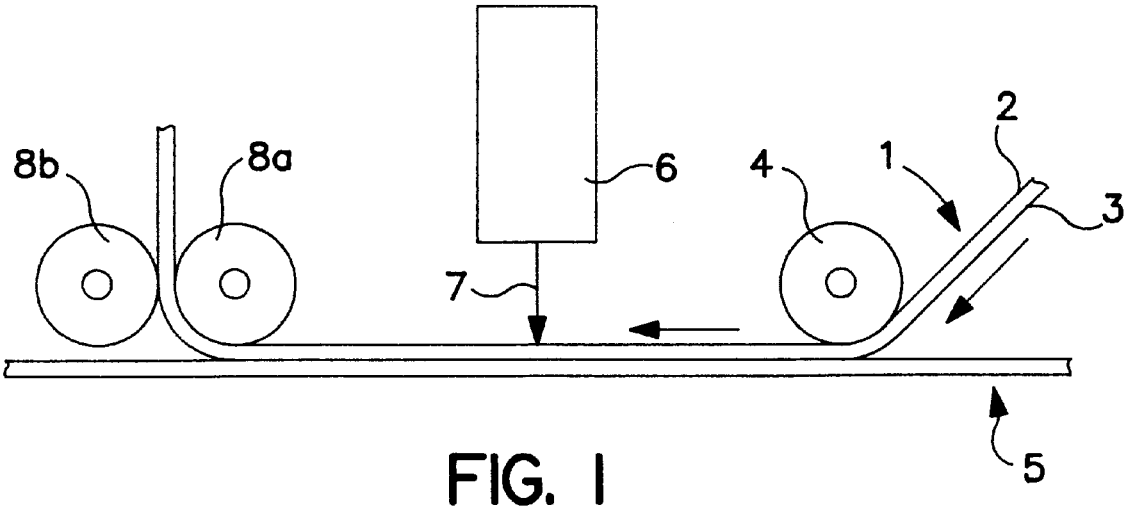
FIG. 1 shows schematically a first embodiment of the invention using a dye transfer ribbon.

In the embodiment of FIG. 1, a dye transfer ribbon 1 comprises a supporting substrate 2 and a relatively thick dye layer 3 consisting of a dye dispersed within a dye binder. The ribbon 1 passes around a roller 4 and contacts a receiver sheet 5 consisting of a dye receiving layer mounted on a supporting substrate. The ribbon 1 and receiver sheet 5 are placed in contact and moved passed a laser source 6 which scans a laser beam 7 across the width of the ribbon 1. The beam 7 is modulated as it is scanned to heat selected pixel regions of the ribbon 1 and cause dye to diffuse from these regions to the receiver sheet 5 and print a number of pixels which build up to form an image. The ribbon 1 then passes between a pair of heated rollers 8*a*, 8*b* to cause dye in the dye layer 3 to diffuse to an even density, so that the regions depleted of dye during the print process are replenished.

The ribbon 1 may be in any suitable form, and may comprise a continuous loop or be housed in a reversible cassette. Instead of using a pair of heated rollers 8*a* 8*b*, only one of the rollers may be heated, and indeed, the outer roller 8*b* could be omitted. The receiver sheet 5 could be transparent to the laser beam 7, in which case the beam 7 could impinge on the ribbon 1 through the receiver 5, and the laser source 6 could be mounted on the receiver side of the apparatus.

Figure 2:
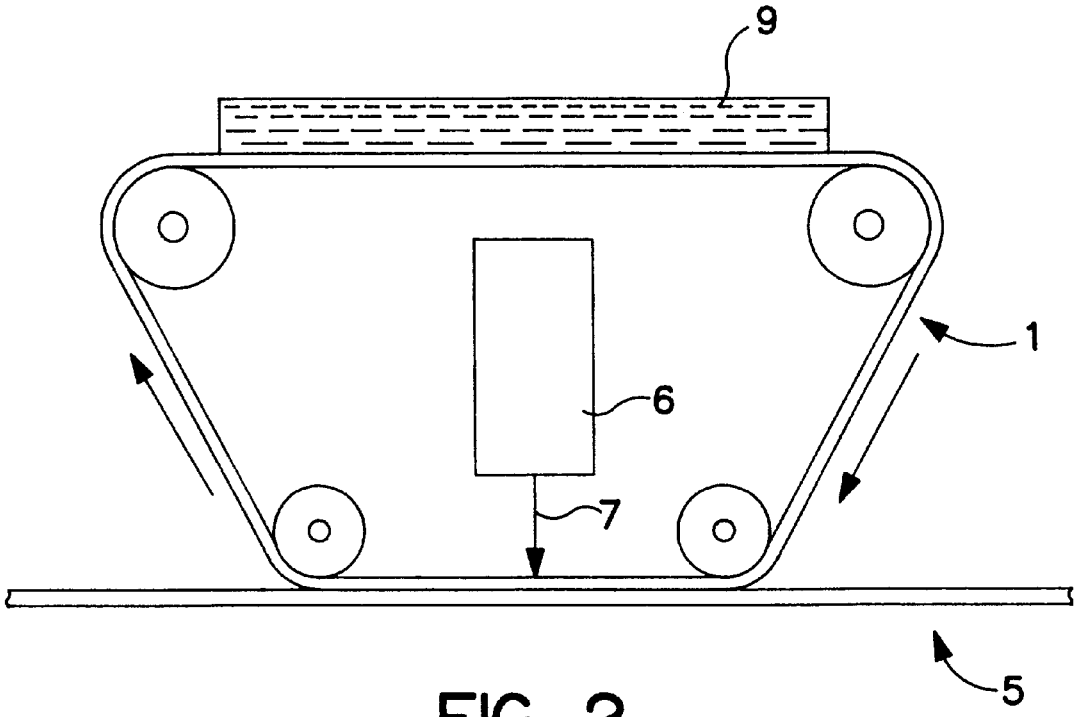
FIG. 2 shows a second dye transfer ribbon embodiment.

FIG. 2 shows an apparatus again using a ribbon 1 and laser source 6, but, in this embodiment, the ribbon 1 is in the form of a continuous loop, and the regions of the ribbon depleted through printing are replenished by fresh dye from a separate heated dye reservoir 9.

The ribbon dye layer in this embodiment need not be as thick as that in the first embodiment, as it does not need to hold a reservoir of dye. Moreover, the ribbon 1 may not need to be changed as often as in the first embodiment, because the dye concentration can be kept constant and will not fall below that required for producing a print of acceptable quality.

Again, the receiver 5 may be transparent to the laser beam 7 so that the laser source 6 may be mounted upon the receiver side of the apparatus and not interfere with the mounting of the dye reservoir 9.

Figure 3:
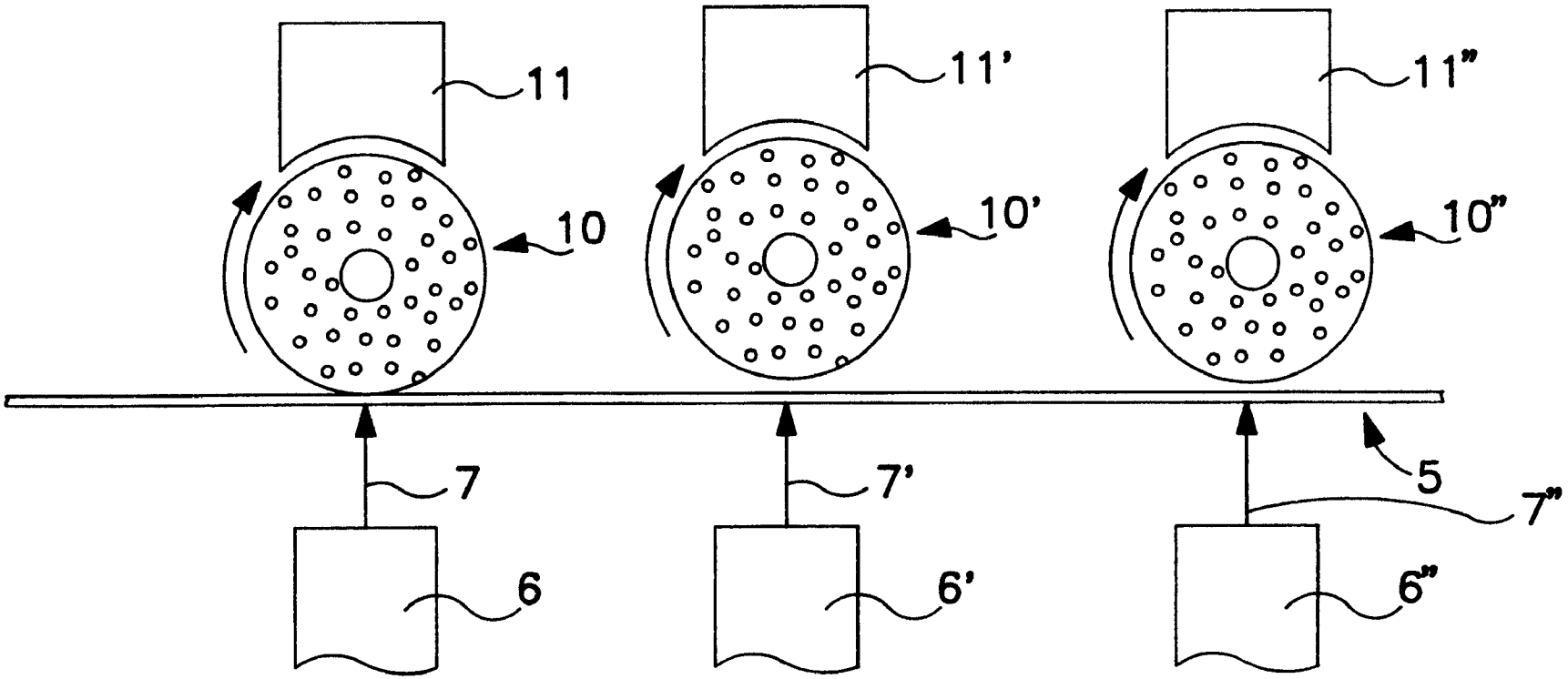
FIG. 3 shows an embodiment using roller dye pad.

In the FIG. 3 embodiment, a dye pad 10 is used instead of a transfer ribbon 1. The receiver sheet 5 is transparent to the laser beam 7, so that the beam 7 can scan across the surface of the dye pad 10 and cause diffusion of dye from the surface regions of the pad 10 to the receiver sheet 5. After a surface region of the pad 10 has been scanned by the beam 7, it is passed across a low-level heater 11 which causes dye in the pad 10 to diffuse into the regions depleted by the printing and form an even distribution of dye. The pad 10 may comprise a porous carbon roller having pores of between 0.01 and 10 $\mu$m, and may be resistively heated instead of or in addition to the low-level heater which may be a filament lamp. As indicated schematically on FIG. 3, and as will be obvious to those skilled in the art, multi-color printing can be accomplished by transferring a number of separate prints onto a single receiver sheet 5, each separate print using a dye of a different color. Thus, the dye pads 10, 10' and 10" will contain different color dyes which will be caused to diffuse to the receiver sheet 5. As shown in the case of pads 10' and 10", it may be desirable to include an air gap between the individual dye donors and the receiver 5 to prevent reverse color migration from the receiver to the donors.

As an alternative to this embodiment, the peripheral surface only of the pad 10 may be suitable for dye diffusion, and the pad may receive fresh dye from a heated dye reservoir mounted in place of the low-level heater 11.

Figure 4:
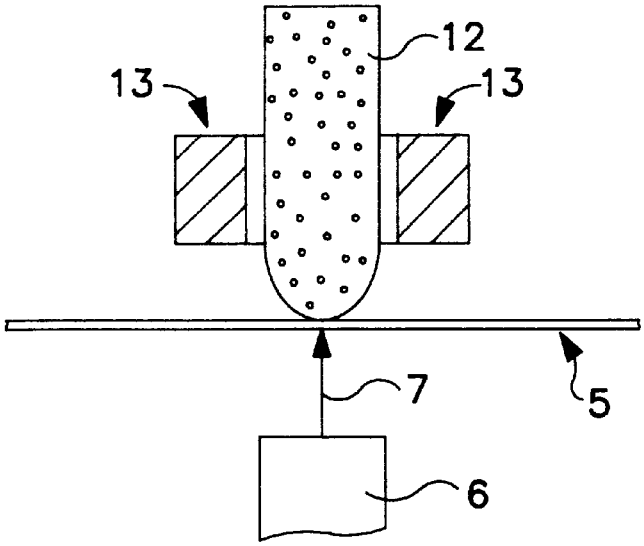
FIG. 4 is an alternative dye pads embodiment.

FIG. 4 is also a dye pad embodiment, but, in this case, the dye pad 12 is stationary so that dye is transferred to the receiver 5 from the same pad surface regions. The pad 12 is surrounded by a heater 13 to ensure that it is heated sufficiently to enable dye to continually diffuse through the pad to the transfer regions during printing.

Figure 5:
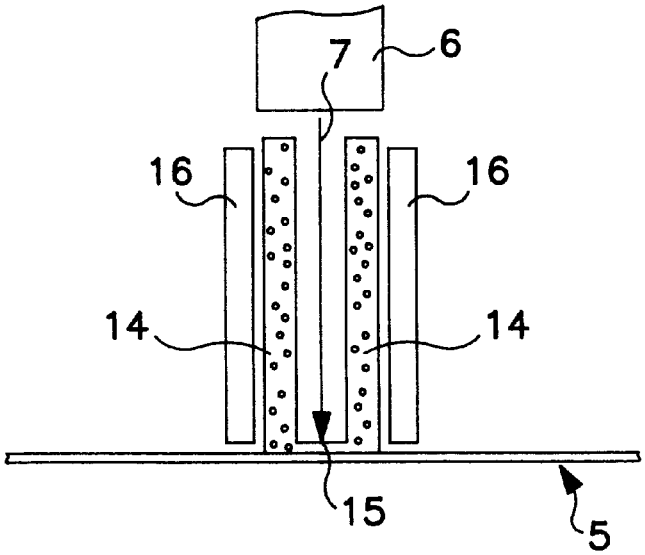
FIG. 5 is a third dye pad embodiment.

In this embodiment, the receiver sheet 5 is again transparent to the laser beam 7 to allow the pad 12 and laser source 6 to be mounted on opposite sides of the receiver sheet 5 out of each other's way. It is, however, possible to mount the laser source 6 on the same side of the receiver sheet 5 as the dye pad 12, and an embodiment achieving this is shown in FIG. 5.

In this embodiment, a stationary pad is made up of two separate pad portions 14 connected together at one end by a short thin bridge element 15 transparent to the laser beam 7. Dye in the pad portions 14 are heated by heating elements 16, so that the dye diffuses across the bridge 15 where the laser beam 7 may heat it and cause transfer to the receiver sheet 5.

Instead of being formed of separate dye portions 14, the dye pad could comprise a single, for example cylindrical, dye pad having a channel along its centre axis with the transparent bridge 15 extending across one end of the channel. The laser beam 7 may then propagate down this channel to impinge on the bridge 15.

Figure 7:
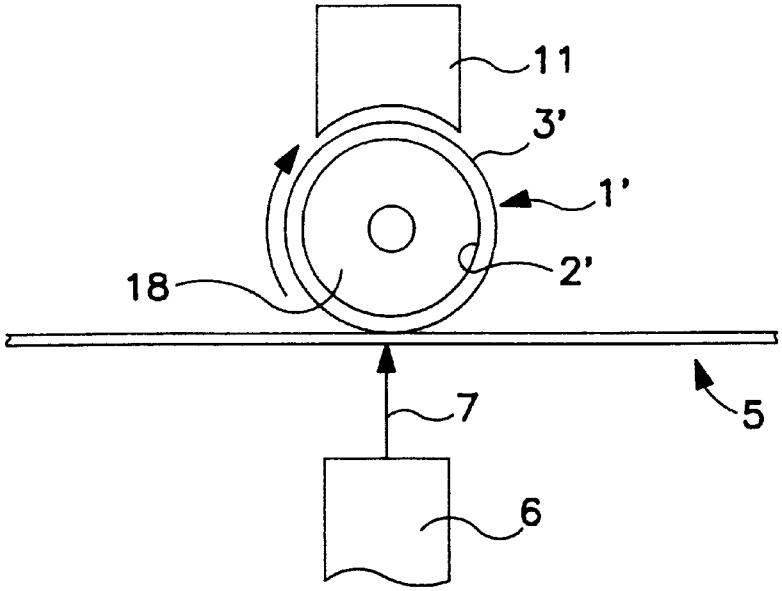
FIG. 7 depicts another embodiment of the invention employing a dye sheet mounted on the outer periphery of a rotating drum.
Figure 8:
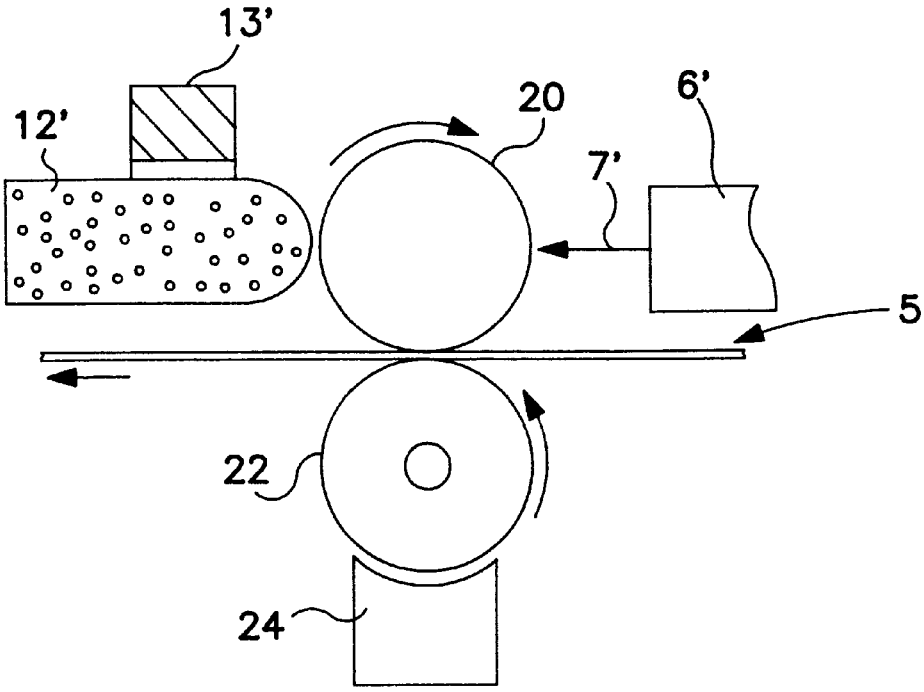
FIG. 8 shows yet another embodiment of the invention which employs an intermediate carrier for transferring a printed image.

It will be appreciated that the above are merely specific embodiments of the present invention, and that other variations also fall within the scope of the invention. For example, an array of heated resistive wires, or ultrasound, may be used as the heat source, instead of a laser beam. Also, as represented in FIG. 7, the donor may be a dyesheet 1', having a support substrate 1' and a dye layer 3', and may be mounted on a carrier, such as a rotating drum 18. Further, as shown in FIG. 8, the receiver sheet could be replaced by one or more intermediate carriers which transfer a finished printed image to a final receiver sheet, such as a glass roller 20 frosted to provide an air gap. As described above, the laser beam 7' may pass through roller 20 to cause dye transfer to the surface of roller 20 from dye donor pad 12'. Final image transfer to receiver medium 5 may be achieved by passing the receiver through a nip between roller 20 and a rubber roller 22 which is heated by a heater 24. Also, colour prints may be produced by printing a number of images onto a single receiver sheet, each image using a differently coloured dye, and means being provided to prevent reverse migration of already printed dye into the donor means of subsequent dyes.

EXAMPLE 1

The principle of a self-replenishing dyesheet is demonstrated in this example. It involves the use of a thick dye layer which when imaged becomes depleted of dye at the surface of the coating. This depleted area is then replenished after printing by passing the dyesheet through a hot roll laminator to facilitate mobilisation and redistribution of dye.

A dye coat solution of the following formulation was coated on to S grade melinex:

| | | |
|---|---|---|
| Magenta Dye | 0.833 g | |
| IR absorbing dye | 0.197 g | |
| PVBBX1 | 0.444 g | (polyvinyl butyral from Sekisui) |
| ECT10 | 0.111 g | (ethyl cellulose from Hercules) |
| THF | 11.11 g | (tetrahydrofuran) |

The coating was laid down with a K bar to give a dry coat thickness of 4.5 $\mu$m.

The standard printing procedure used was as follows. The dyesheet was placed against a transparent receiver film and the two held together against an arc to retain laser focus by the application of 1 atmosphere pressure. The media was arranged so that the dyesheet rested underneath the receiver film (i.e. the incident laser light passing through the receive before being absorbed in the dyecoat). An SDL 150 mW diode laser operating at 807 nm was collimated using a 160 mm achromat lens and projected through the receiver film to be absorbed in the dyecoat. The incident laser power was about 100 mW and the full spot size (full width at half power maxima) about 30×20 $\mu$m. The spot was scanned across the media by a galvanometer to address the laser to locations 20×10 $\mu$m apart to give good overlap of adjoining dots. At each location the laser was pulsed for a specific time to build up a block of colour on the receiver. Blocks of varying optical density were produced by varying the laser pulse times. The extent of dye transfer was determined by measuring the transmission optical density of the printed block on the receiver using a Sakura densitometer (manufactured by Konishiroku) operating with a green filter.

Figure 6:
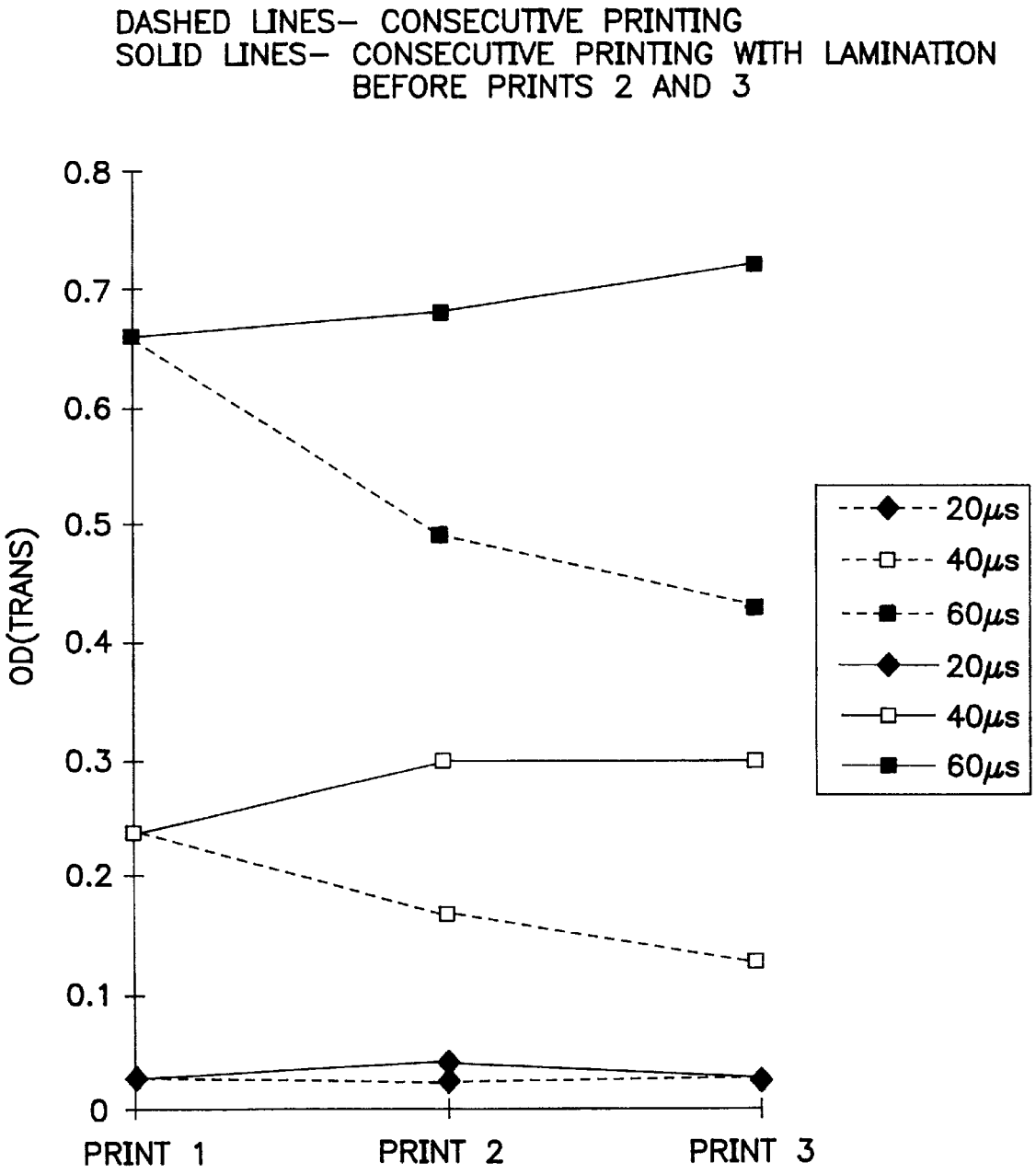
FIG. 6 is a graph showing the optical density of successive prints from a self-replenishing dye sheet.

The depletion of dye in the dyecoat was observed by repeated printing with a single dyesheet. In FIG. 6, the points joined by dashed lines represent the OD obtained from the dyesheet after 1, 2 and 3 consecutive prints at different laser pulse times. The diagram shows that the dyesheet becomes gradually more depleted particularly when printing with longer laser pulse times.

Only a fraction of dye within the dyecoat is transferred during these printing steps, the depletion occurring in the surface region of the dyecoat. By allowing the dye to redistribute after the printing step, the depleted areas of the coating become replenished with dye thereby improving the optical density delivered by the dyecoat. This was demonstrated by carrying out a second print test with a fresh piece of dyesheet, but before each of prints 2 and 3, the dyesheet was removed from the printer and laminated against polypropylene coated paper using an Ozatec 350 Hot Roll Laminator operating at 150° C. and 0.5 m/min in order to facilitate redistribution of dye within the dyecoat. (PP coated paper provides a surface against which the dyecoat can be laminated without removal of the dye coating from the substrate, and into which the dye will not diffuse to any great extent. In principle the dyecoat could be laminated against any other surface to which it has no or very low adhesion, and which has low affinity for the dye in the coating).

The results from this second print test are also summarised in FIG. 6 where the points joined by solid lines show the OD obtained for the same laser pulse times as in the previous test. Comparison of the solid lines with the dashed lines in the figure shows the improvement in OD seen when the dyesheet has been heated, allowing the unused dye to replenish the depleted regions in the coating prior to re-use.

EXAMPLE 2

The principle of a porous pad (as exemplified by the use of filter paper), which is replenished from a separate reservoir, is demonstrated in this example. The following dye solution was used (masses are in grammes):

| | |
|---|---|
| M3 | 4.2 |
| PVBbx1 | 2.8 |
| S101743 | 2.8 |
| Tospearl 3 $\mu$m | 3.2 |
| THF | 216 ml |

The dye M3 is 3-methyl-4(3-methyl-4-cyanoisothiazol-5-ylazo)-N-ethyl-N-acetoxy-ethylaniline.

The infra-red absorber S101743 is Hexadeca-β-thionaphthalene copper(II)phthalocyanine.

The silicone gel spheres, Tospearl, provide an air gap between the dye and receiver sheets.

The filter paper was initially dipped twice into a reservoir of the dye solution and allowed to dry for ca. 10 mins. before printing.

Printing entailed imaging a block of colour 2.7×2.6 cm (1500×1500 pixels) onto a transparent receiver sheet, which consisted of a 10% solution of Vylon 200 in THF with a K5 bar and dried for 30 sec. at 100° C. The printer delivered an energy of 3.802 J/cm$^2$.

All laminations were carried out at 140° C. at a speed of 0.5 m/s.

All prints were post-heated after printing to fix the prints, as dye sublimation was occurring. This was done at 140° C. for 1 min.

The dyesheet was initially laminated to smooth out the surface of the filter paper and ensure an even distribution of dye. It was then fixed to the printer platen and a series of print runs were made without any treatment to the dyesheet between prints. The results were:

| Print No. | Mean OD |
|---|---|
| 1 | 1.68 |
| 2 | 1.15 |
| 3 | 0.91 |
| 4 | 0.8 |
| 5 | 0.65 |
| 6 | 0.5 |

The same experiment was repeated, but, in this case, the dyesheet was dipped into the dye solution between prints. It was allowed to dry for ca. 10 mins. before being laminated ready for printing again. The results were:

| Print No. | Mean OD |
|---|---|
| 1 | 1.15 |
| 2 | 2.15 |
| 3 | 2.5 |
| 4 | 2.65 |
| 5 | 2.75 |

Comparison of the results of the two experiments shows the improvement in OD seen when the dyesheet is replenished, and the ability of the dye sheet to be used more than once.

EXAMPLE 3

The principle of replenishment by exposure of a dyesheet to dye vapour is demonstrated in this example. A piece of 50 μm S-grade Melinex was coated with a solution of binder, IRA and filler with a K3 bar, as follows (masses in grammes):

| | |
|---|---|
| PVBbx1 | 3.33 |
| S101743 | 1.2 |
| Tosp.4.5 μm | 0.9 |
| THF | 75 ml |

The coated Melinex was then stretched taut over a Petri dish the bottom of which was covered with a carpet of magenta M3 dye. The dish was placed in a vacuum oven at 150° C. and the pressure reduced to 1000 mBar. The dish was left for two hours after which the Melinex was removed and subjected to laser printing.

The (opaque) receiver consisted of a 10% solution of Vylon 200 in THF coated with a K5 bar. Printing entailed imaging a block of colour 2.7×2.6 cm (1500×1500 pixels); the printer delivered 3.345 J/cm$^2$. The receiver was post-heated for 1 min. at 140° C. to fix the dye. Subsequent replenishments were for the same two hour period with the same conditions.

The initial heating gave a mean dyesheet OD of 4.65 in transmission, the first replenishment increased this to 4.94 and the OD was constant thereafter. The results were:

| Replenished: | | Non-replenished: | |
|---|---|---|---|
| Print No. | OD (ref.) | Print No. | OD (ref.) |
| 1 | 1.2 | 1 | 1.3 |
| 2 | 0.8 | 2 | 0.8 |
| 3 | 1.01 | 3 | 0.7 |
| 4 | 0.96 | 4 | 0.59 |

Again, comparison of the results shows the ability of the replenished dyesheet to be reused, without degradation of the optical density.

We claim:

1. A dye diffusion thermal transfer printing system comprising a dye pad consisting of a solid body portion throughout which a thermally diffusible dye may diffuse, a receiver for receiving dye from said dye pad, and a heater for heating selective regions of said dye pad to cause dye in the heated regions to transfer to the receiver, wherein means are provided for replenishing, with thermally diffusible dye, regions of the dye pad which have become depleted of dye through printing, said dye depleted regions being supplied with dye from other regions of said dye pad.

2. The system of claim 1 wherein said dye pad comprises a roller having printing and replenishment stations around its periphery.

3. The system of claim 1 wherein said dye pad comprises a porous carbon roller.

4. The system of claim 1, wherein the replenishing dye is held in a separate source which transfers dye to the donor means.

5. A dye diffusion thermal transfer printing system comprising a dye donor carrying an amount of thermally diffusible dye, a receiver for receiving dye from said donor, and a heater for heating selective regions of said donor to cause dye in said heated regions to transfer to said receiver, wherein means are provided for replenishing, with thermally diffusible dye, regions of said donor which have become depleted of dye through printing, and wherein said receiver comprises an intermediate carrier which bulk transfers a printed image to one or more further receivers.

6. A system according to claim 5, wherein said intermediate carrier is a laser light transparent material having low affinity for said dye.

7. A system according to claim 6 wherein said intermediate carrier is a roller.

8. A system according to claim 6, wherein said intermediate carrier has a relieved surface providing an air gap between said dye donor and said intermediate carrier, wherein transfer of said dye from said donor to said intermediate carrier is effected by sublimation of said dye.

9. A system according to claim 8, wherein the relieved surface of the intermediate carrier has a frosted texture.

10. A system according to claim 5 wherein an air gap is provided between said donor and said receiver to prevent reverse color migration from said receiver to said donor.

* * * * *